US005123874A

United States Patent [19]

White, III

[11] Patent Number: 5,123,874

[45] Date of Patent: Jun. 23, 1992

[54] KNOCK-DOWN SOUND ATTENUATING SYSTEM

[76] Inventor: Thomas B. White, III, 7510 C Sweet Hours Way, Columbia, Md. 21046

[21] Appl. No.: 594,703

[22] Filed: Oct. 9, 1990

[51] Int. Cl.[5] ..... F24F 7/007; F24F 13/24

[52] U.S. Cl. ..... 454/251; 52/586; 181/30; 181/290; 454/237; 454/906

[58] Field of Search ..... 98/32, 33.1, DIG. 10, 98/31.5, 31.6, 34.5, 34.6; 181/30, 284, 290, 224, 205; 52/403, 586, 144, 145, 127.5, 127.6, 127.7, 127.8, 127.9, 127.10, 127.11, 64, 66

[56] References Cited

U.S. PATENT DOCUMENTS

| | | | |
|---|---|---|---|
| 508,968 | 11/1893 | Newington | 52/586 X |
| 1,966,288 | 7/1934 | Foltz | 98/32 |
| 2,061,535 | 11/1936 | Davies | 181/224 X |
| 2,386,588 | 10/1945 | Brunton et al. | 52/586 X |
| 3,158,457 | 11/1964 | Whitfield | 98/31.5 X |
| 3,302,547 | 2/1967 | Wasserman | 98/33.1 |
| 3,310,919 | 3/1967 | Bue et al. | 52/127.11 |
| 3,611,907 | 10/1971 | Wasserman et al. | 98/DIG. 10 X |
| 3,799,703 | 3/1974 | Paine et al. | 98/42.02 X |
| 4,120,376 | 10/1978 | Palmer | 181/284 X |
| 4,840,440 | 6/1989 | Dieter | 52/586 X |

FOREIGN PATENT DOCUMENTS

| | | | |
|---|---|---|---|
| 2744477 | 4/1979 | Fed. Rep. of Germany | 98/33.1 |
| 1339775 | 9/1963 | France | 98/33.1 |
| 643181 | 9/1950 | United Kingdom | 181/30 |

*Primary Examiner*—Harold Joyce

*Attorney, Agent, or Firm*—Morton J. Rosenberg; David I. Klein

[57] ABSTRACT

A knock-down sound attenuating system (10) is provided as a portable enclosure having significant sound attenuating properties, while still being easily assembled and disassembled. The knock-down sound attenuating system (10) includes a plurality of sound attenuating wall partitions (14,16) whose longitudinally extended end portions have at least one longitudinally extended recess (78) formed therein. System (10) further includes a coupling gasket (50,70) having at least a pair of opposing projecting members (52 and 54), (74 and 76) for receipt within a recess (78) formed in a respective one of the wall partition end portions. Coupling gaskets (50,70) simultaneously provides both an interlocking between adjacent wall partitions (14,16) and an acoustic seal for the interface therebetween. To secure one wall partition (14,16) to another, system (10) further includes a flexible coupling system (18) comprising a strap-like member (28) coupled adjacent a longitudinal side of a partition (14). Strap-like member (28) extends across the joint formed between two adjacent wall partitions (14,16) for releasable engagement with a coupling (38) disposed adjacent the longitudinal edge of the adjacent wall partition (14,16).

19 Claims, 7 Drawing Sheets

KNOCK-DOWN SOUND ATTENUATING SYSTEM

BACKGROUND OF THE INVENTION

1. Field of the Invention

This invention directs itself to sound attenuating enclosures. In particular, this invention directs itself to a sound attenuating enclosure having a knock-down structure formed by prefabricated partitions which together form a modular system. Still further, this invention directs itself to a knock-down sound attenuating system wherein one panel is secured to another by means of a releasable coupling system. More in particular, this invention pertains to a knock-down sound attenuating system having a releasable coupling formed with a coupling gasket which both interlocks one panel to another and forms an acoustic seal. Further, this invention directs itself to a knock-down sound attenuating system wherein each of the panels is secured to another by means of a flexible coupling secured to each panel. Still further, this invention directs itself to a flexible coupling system having a strap-like member secured to one wall panel and releasably coupled to an adjoining panel.

2. Prior Art

Knock-down structures and sound attenuating enclosures are well known in the art. The best prior art known to the Applicant includes U.S. Pat. Nos. 1,948,755; 2,771,334; 3,159,235; 3,229,429; 3,287,869; 3,343,314; 3,482,505; 3,592,289; 4,016,689; 4,193,472; 4,258,511; 4,423,573; 4,511,238; 4,702,046; 4,709,517; and, 4,891,920.

Some prior art such as that shown in U.S. Pat. No. 3,592,289 is directed to acoustical space dividers defined by individual panels flexibly connected one to another by a plastic hinge-like coupling strip. Each such coupling strip includes two pairs of opposing projecting members, one pair disposed at each end of the coupling strip, for receipt within a T-shaped slotted opening formed on end portions of each panel. However, in order to firmly interlock one panel with another such requires two of these hinge-like gaskets coupled on opposing surfaces of the two adjoining panels. Further, such prior art systems do not disclose the means by corner joints between the panels may be firmly secured one to another. Still further, such hinge-like connections between panels do not simultaneously provide substantial acoustic attenuation through the interface.

In other prior art systems, such as that disclosed in U.S. Pat. Nos. 4,891,920; 4,709,517; 4,702,046; 4,423,573; 4,258,511; 4,016,689; and, 3,159,235, there are provided sound absorbing panel systems which may be formed into enclosures or space dividers. While such prior art systems may each include one or two elements of the instant invention, none disclose or suggest the combination of elements forming the inventive concept of the instant invention.

Other prior art systems, such as that disclosed in U.S. Pat. No. 2,771,334 are directed to portable systems having a plurality of panels hingedly coupled together. The portable bar formed by a collapsible framework includes a plurality of flexible sheets tensioned across the frame members, however, such does not form the flexible coupling of the instant invention. While the structure includes a strap member 58 and buckle 59, such is for securing the structure when it is folded for storage or transport.

Still other prior art systems, such as that disclosed in U.S. Pat. No. 3,229,429 disclose sound attenuating enclosures having a multi-wall structure. However, there is not disclosed any means for easily assembling or disassembling the structure.

SUMMARY OF THE INVENTION

A knock-down sound attenuating system which is easily assembled and disassembled is provided. The knock-down sound attenuating system includes a plurality of sound attenuating wall partitions having a predetermined height dimension and being releasably coupled each to another at adjacent end portions thereof. The adjacent end portions of the sound attenuating wall partitions each have at least one longitudinally extended recess formed therein. The recess extends longitudinally a distance substantially equal to the predetermined height dimension of the respective wall partition. The sound attenuating system further includes a gasket structure for interlocking the wall partitions disposed between adjacent wall partition end portions. The gasket structure includes a longitudinally extended body member and at least two opposing projecting members. Each of the opposing projecting members being insertable into the recess formed in a respective one of the wall partition end portions. The sound attenuating system further includes a flexible coupling system coupled to each of the plurality of wall partitions for releasably securing each wall partition to another.

DESCRIPTION OF THE PREFERRED EMBODIMENTS

Referring now to FIGS. 1–15, there is shown knock-down sound attenuating system 10 which can easily be assembled to form an enclosure, the sound levels emanating therefrom being at a significantly reduced level from that which is generated within the enclosure. As will be seen in following paragraphs, knock-down sound attenuating system 10 is specifically directed to the concept of providing a portable enclosure having significant sound attenuating properties whereby sound sources such as musical instruments can be utilized to their fullest extent without disturbing individuals external to the enclosure. Although not restricted to applications in the musical arts, sound attenuating system 10 is particularly adapted to provide an environment whereby musicians, vocalists and the like, can freely practice their art in their home, apartment, in a school, or an office without fear of disturbing those who reside in adjacent areas. In addition to significantly attenuating sound levels which are generated within sound attenuating system 10, system 10 likewise significantly attenuates sound levels generated external thereto. Thus, sound attenuating system 10 may be suitably applied to factory environments wherein enclosures must be provided for individuals to work without exposure to the high sound levels produced by the factory machinery, but in close proximity thereto.

Figure 2:
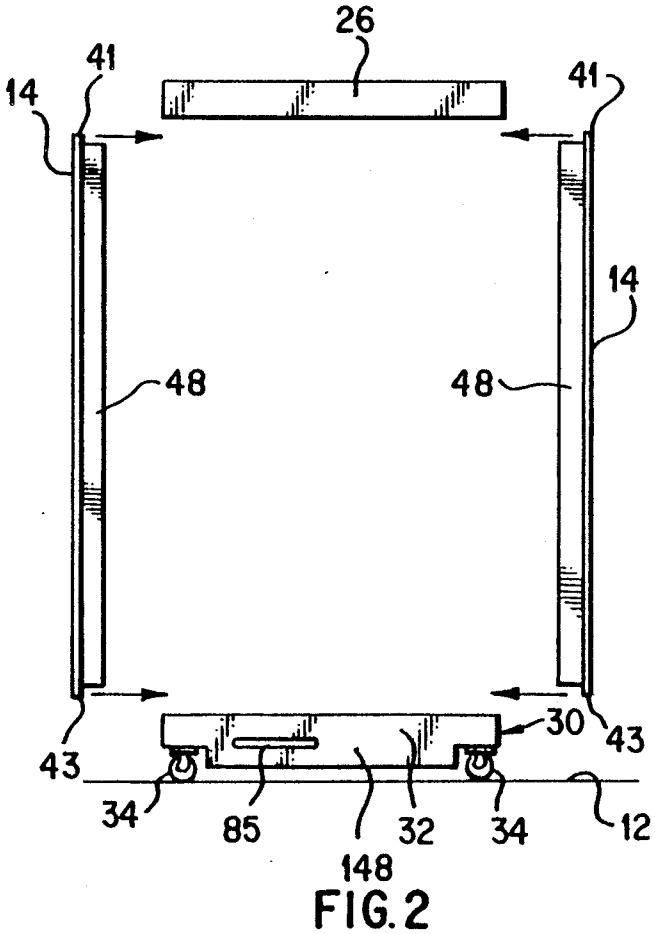
FIG. 2 is an exploded view of the enclosure formed by the sound attenuating system.
Figure 1:
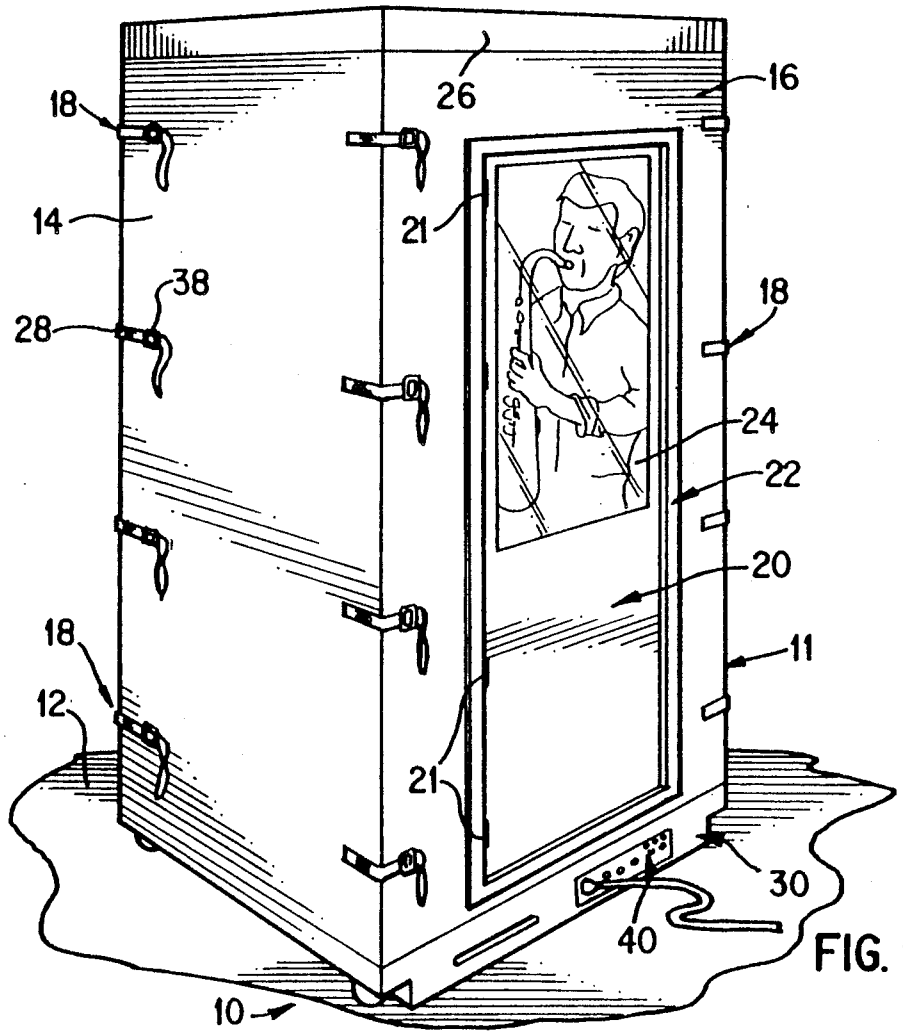
FIG. 1 is a perspective view of the knock-down sound attenuating system.

Knock-down sound attenuating system 10 includes a plurality of sound attenuating wall partitions 14, as shown in FIGS. 1 and 2, releasably coupled together to form an enclosure. Sound attenuating wall partitions 14 are releasably coupled one to another in a unique and novel fashion, as will be more fully described in following paragraphs. As shown in FIG. 1, a plurality of sound attenuating wall panels or modules are joined together and secured by means of flexible couplings 18 to form the enclosure 11. Access to and from enclosure 11 is provided through a door assembly 20 mounted by hinges 21 in a sound attenuating wall partition 16 coupled on opposing sides to adjacent sound attenuating wall partitions 14. Each of wall partitions 14, 16 are provided with a plurality of flexible strap-like members 28 coupled adjacent one longitudinal end of the wall partition, and in longitudinal spaced relation each with respect to another. In similar spaced relation, a releasable strap coupling 38 is coupled adjacent the opposing longitudinal end of each partition. Thus, each of the partitions 14, 16 may be interchangeably located on any side of the enclosure 11.

Although the wall partitions 14 may be supported directly on the base surface 12, for most applications it will be desirable to support the wall partitions 14 on the base assembly 30. As shown in FIGS. 1 and 2, the wall partitions 14 and 16 are adapted to be supported on respective perimeter portions cf the base assembly 30. As will be described in following paragraphs, base assembly 30 is provided with a gasketing system to acoustically isolate the wall partitions therefrom. Base assembly 30 includes a base housing 32 to which a plurality of wheels or casters may be coupled to allow for ease of relocating the assembled enclosure 11.

An upper sound attenuating closure is provided for system 10 in the form cf ceiling assembly 26. Ceiling assembly 26, as shown in FIG. 2, is supported by upper end portions of at least two opposing sound attenuating wall partitions 14. As will hereinafter be further described, each wall of enclosure 11 may be formed by a plurality of wall partitions 14, a plurality of base assemblies 30 and ceiling assemblies 26, each joined one to a respective other by means of an interlocking coupling gasket and a releasable flexible coupling system 18.

Figure 3:
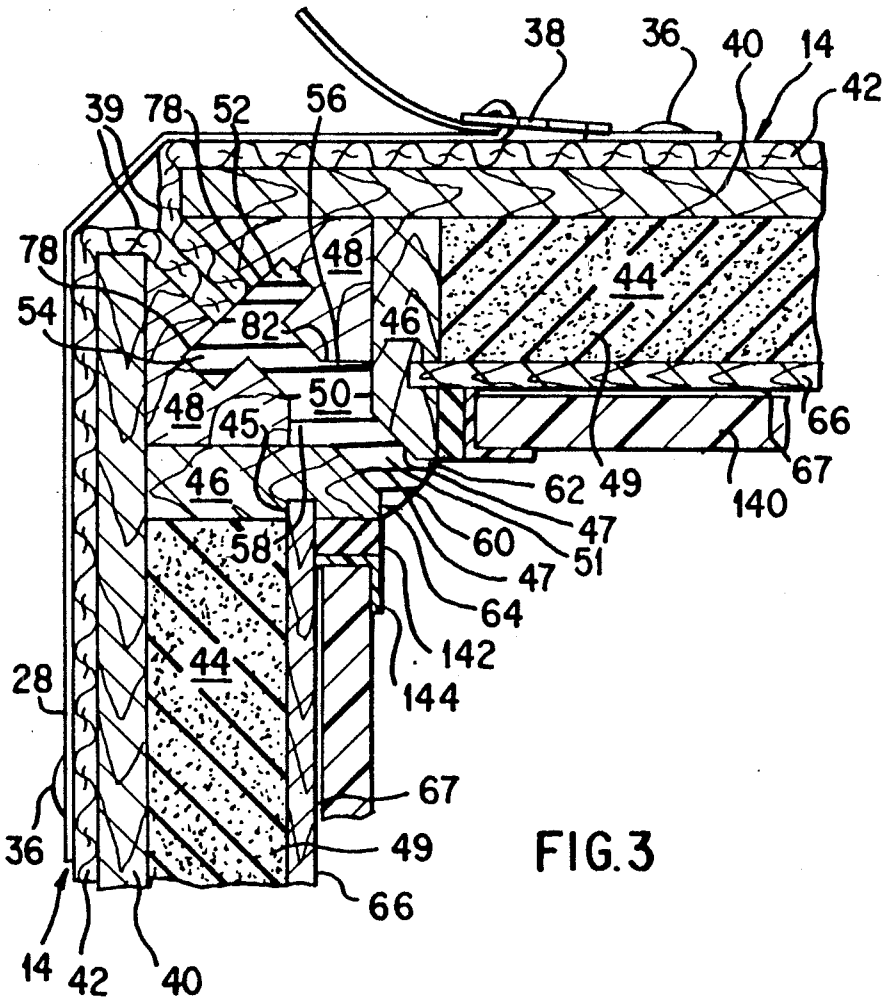
FIG. 3 is a cross-sectional view of the corner connection of the sound attenuating system.

Referring now to FIG. 3, there is shown a cutaway cross-sectional view of the juncture between two wall partitions 14. The basic structural member for wall partition 14 is the outer panel 40 which additionally defines the overall length and width of partition 14. While a plywood sheet has been successfully used for outer panel 40, other structural materials may be utilized. The materials disclosed as being utilized in constructing a working embodiment according to the inventive concept are not to be taken as a limitation on the invention, the structural members, while being disclosed as being formed of a wood composition, other materials, such as metal, plastic, and composites or the like may be substituted for those structural elements, all without departing from the spirit or scope of the instant invention.

Coupled adjacent the longitudinal edge of outer panel 40 there is provided angular gasket retaining member 48 and side slat member 46, both extending longitudinally for substantially the entire length of panel 40, with the exception of relatively small overhanging portions extending along the upper edge 41 and lower edge 43 of each partition 14, as clearly shown in FIG. 2. Obviously, side slat member 46 and angular gasket retaining member 48 may be integrally formed in one piece, as opposed to being constructed of two separate members, as shown.

Each of the side slat members 46 disposed on opposing sides of partition 14 includes an inner panel receiving slotted opening 45 formed therein, the slotted opening 45 being located a predetermined distance from an end of slat member 46. An inner panel 66 is captured on opposing sides within the respective slotted openings 45, formed in the slat members 46 located on opposing sides of partition 14, thereby defining a cavity 49 into which is received a sound absorbing material 44. Sound absorbing material 44 may be a foamed plastic composition, or materials such as Fiberglas or rock wool, or other materials which are appropriate for the degree of sound attenuation desired. Similarly the size of cavity 49 is predetermined, by virtue of the distance between panels 66 and 40, in accordance with the degree of sound attenuation required for a particular application.

The interior facing surface of inner panel 66 may be finished with an esthetically pleasing decorative panel, however, additional sound attenuation can be achieved by utilizing acoustical ceiling-type tiles 140 to provide the decorative interior finish for enclosure 11. The interior wall surface of each wall partition 14 is thereby formed by a plurality of acoustical ceiling tile members 140, which are secured in abutting relationship along the length of the partition.

As a means of securing the acoustical tile members 140 to the wall partition structure, right angle retaining members 144 are provided and coupled to the interior end portions of the side slat members 46. Each of the right angle retaining members 144 are coupled to a respective slat member 46 by means of a double adhesive-backed gasket strip 142. The gasket strip 142 may be formed of a rubber or foamed plastic composition to provide a resilient coupling for the retainer members 144. Obviously, other means for resiliently coupling retainer 144 may be utilized in lieu of the gasket element 142. The resiliency of gasket 142 allows a pair of retainer members 144, each disposed adjacent an opposing longitudinal end portion of partition 14, to be located so as to provide an interference fit with the ceiling tile members 140. Thereby frictionally holding the opposing edges of each acoustical tile member 140, allowing the tiles to be slid into position and subsequently easily removed, if replacement is required. The tiles being retained within the angular members as opposed to being fastened to the inner panel 66, permits an air space 67, if desired, to be maintained between the rear surface of the acoustical tile 140 and the inner panel 166.

Of particular interest with respect to the inventive concept, is the method by which adjacent wall partitions 14 are releasably coupled one to the other. In addition to the flexible coupling system 18, already discussed, a gasket 50 having a predetermined cross-sectional contour is provided between adjacent ends of wall partitions 14 for interlocking one partition to another. Each of the longitudinally extended angular gasket retaining members 48 is provided with at least one longitudinally slotted opening 78 for receipt of a portion of the coupling gasket 50 to provide a means of interlocking adjacent partitions, and simultaneously providing a seal against acoustic leakage. In addition to slotted opening 78, a second slotted opening, or recess 82 may be formed in the gasket retaining member 48 for receipt of a second projecting portion of the coupling gasket 50.

As shown in FIG. 3, coupling gasket 50 is formed with a pair of opposing projecting members, or tongues 52 and 54, each being insertable into a slotted opening 78 of a respective wall partition 14. Likewise, a second set of projecting portions 56 and 58 of coupling gasket 50 may be provided for insertion into the respective elongated slotted openings 82. Extending from the second set of projecting portions 56 and 58 toward the interior terminal end 60 of gasket 50 there is provided a narrowed shank portion 51 which extends through the opening bounded by the opposed beveled edge portions 47 of side slat members 46. The interior terminal end 60 of gasket 50 may also be provided with a pair of opposed interior projecting portions 62 and 64 for improving the interlocking of one wall partition 14 with the other. By this arrangement, each wall partition 14 is interlocked against sliding displacement relative to an adjoining wall partition 14, at each corner of the enclosure 11, by virtue of the gasket 50 which substantially extends the entire length of partition 14.

While coupling gasket 50 prevents a sliding displacement of one wall partition relative to another, the flexible coupling system 18 prevents one wall partition 14 from pulling away from another, thereby maintaining the projections 52, 54, 56 and 58 tightly engaged within their respective slotted openings 78 and 82. The coupling gasket 50 may be extruded from a rubber-like composition, and extends for substantially the entire length of partition 14, exclusive of the upper and lower lip portions 41 and 43. In applications of system 10 it may be desirable to provide a gasket 50 of increased shear strength. For those applications gasket 50 may be formed as a laminate, or a coextrusion, having a ridged core and a resilient outer layer.

Each flixible coupling 18 comprises a strap-like member 28 coupled adjacent a longitudinal side of a partition 14, by means of a fastener 36. Strap-like member 28 is of sufficient length to extend about the corner joint formed between the adjacent wall partitions 14 for releasable engagement with a coupling 38. Coupling 38 may be in the form of a buckle or clasp-type member coupled to a respective longitudinal edge of the adjacent wall panel 14 by means of a fastener 36. Obviously, belt-like member 28 may be formed by rope-like cords, webs or strips of material, or linked elements, such as metallic chain may be utilized. Further, it is contemplated that various detachable fastening means may be utilized in place of the buckle 38, such as elastically biased clasps, hooks or hook-and-loop type fasteners.

The exterior of each wall partition 14 may be provided with a decorative covering 42. However, utilizing a material having a plurality of interstitial spaces for covering 42 provides both a decorative finish and further attenuates acoustic energy conducted through partition 14. One such covering material 42 which has been successfully utilized in sound attenuating system 10 includes a short-napped carpet floor covering type material, which is fastened to the outer surface of the outer panel member 40, and wrapped about the perimeter edges thereof. The wrapped edges 39 at the interface between two adjoining partitions 14 further adds to acoustically seal this joint. Another material which has proved successful has been a cellular foam pad material covered by an additional layer comprising an upholstery cloth.

The knock-down structure defined by the releasably coupled partitions 14 provides for the portability of system 10, as well as allowing for ease of shipment of the system components. However, versatility demands that enclosures of different dimensions be available to the consumer. While an enclosure having a 4'×4' floor space might be sufficient for an individual musician to practice in, such would not be suitable for a multi-piece band, for instance. Thus, sound attenuating system 10 has been designed with a modular concept wherein the dimensions of each element, and its respective weight, are maintained within predetermined limits so as to be easily manipulated by the end user.

Figure 15:
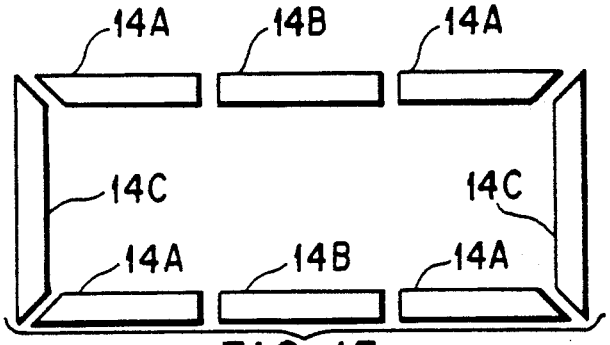

Referring now to FIG. 15, there is shown an exploded diagrammatic representation of an enclosure defined by a plurality of wall partitions 14. A first type of partition 14A is provided with an angular termination along one longitudinal edge and a flat termination on the opposing side.

The flat or straight termination on one end of panel 14A interfaces with a second type of partition 14B having identical straight terminating edges on opposing sides thereof. The structure of the releasable coupling between these straight-sided joints will be more fully described in following paragraphs. The opposing angular end of partition 14A is mated with a third type of partition 14C having angular terminations on opposing ends, the coupling therebetween having been described with respect to FIG. 3. The combination of partitions 14A, 14B and 14C produces a larger enclosure than that depicted in FIG. 1, illustrating the modular construction approach of system 10.

Obviously, a plurality of partitions 14B may be joined between endmost partitions 14A to provide an elongated wall of any desired length. Similarly, the partition 14C may be replaced by a pair of partitions 14A and any number of intermediate partitions 14B. In a manner similar to the method by which the straight or flat end portions of the panels 14A and 14B are joined, the ceiling assemblies 26 and base assemblies 30 can likewise be joined to accommodate larger enclosures.

Figure 4:
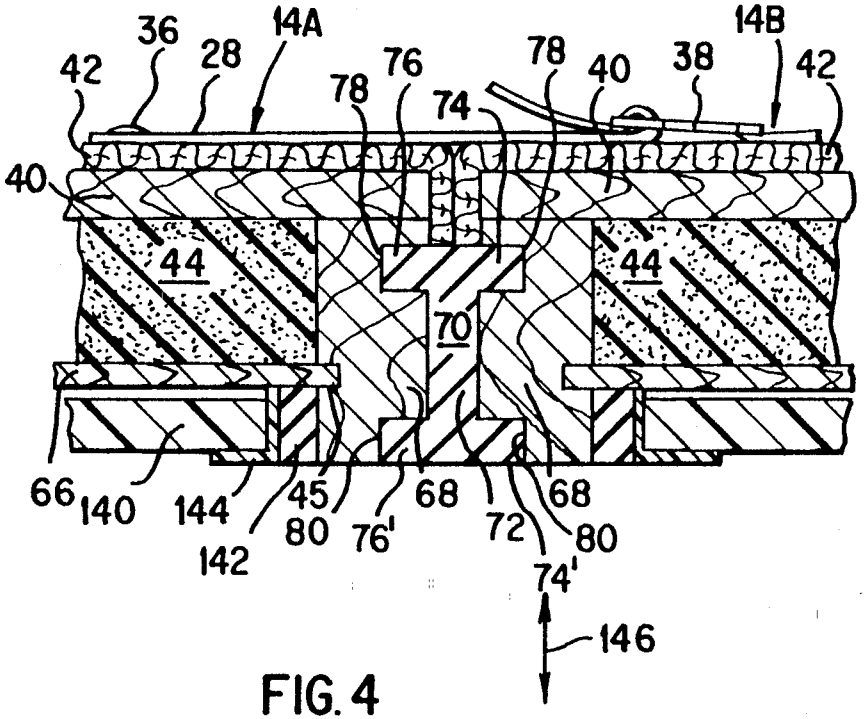
FIG. 4 is a cross-sectional view of the connection between two adjoining straight edged wall partitions.

Referring now to FIG. 4, there is shown the structure for joining the straight edge portions of a pair of partitions 14. In terms of the partition structure, such is substantially identical to that which has already been described with reference to FIG. 3, with the exception that the partition is provided with an elongated terminal end block 68 in place of the angular gasket retaining member 48 and side slat member 46. Obviously, the joint represented in FIG. 4 similarly represents a joint between two flat-edged partitions, such two partitions 14B.

The terminal end block 68 is coupled to the outer panel 40 adjacent a longitudinal side edge thereof, extending substantially the entire length of panel 40, as was previously described for elements 46 and 48. Terminal end block 68 is provided with a longitudinally extended slotted opening 45 formed in an interior surface thereof, for receiving therein an edge of interior panel 66, to define a cavity between panels 40 and 66 for containing a sound absorbing material, as has previously been described. The two partitions 14A and 14B are interlocked by a coupling gasket 70 having at least a pair of projections or tongues 74 and 76 for insertion into respective longitudinally extended slotted openings 78 formed in the outer end surface of each respective partition terminal block 68. Extending from the projecting portions 74 and 76 there is provided an integrally formed narrowed shank portion 72 which terminates at a second pair of projecting members 74' and 76', each being respectively received within a respective recess 80 formed in terminal block 68.

In a manner similar to that previously described, the coupling gasket 70 simultaneously provides both an acoustical seal for the joint between two partitions, extending substantially the entire length of the partions, and interlocks them against a sliding displacement of one with respect to the other, in a direction indicated by the directional arrow 146. To insure retention of coupling gasket 70 within the opposed slotted openings 78 and recesses 80 flexible coupling system 18 is similarly provided at each joint. The strap-like member 28 being fastened to partition 14A adjacent one end, extends across the interface between the two partitions for coupling with the buckle 38 fastened to partition 14B.

The base assembly 30, as shown in FIGS. 1, 2, 5 and 7, in addition to providing a support for the plurality of wall partitions 14, base assembly 30 functions to attenuate sound and provide isolation between the enclosure 11 and the base surface 12. Included within the base assembly 30 there is provided a ventilation system for providing a fresh air exchange within the interior of enclosure 11. Still further, base assembly 30 includes electrical transmission system 40 for coupling electrical power and signal lines to the interior of enclosure 11. Both the ventilation system and electrical transmission system may be incorporated into the wall partitions or ceiling assembly as desired.

Electrical transmission system 40 comprises an external cover plate 150 fastened to an external end surface 152 of the base housing 32. Coupled to cover plate 150 there is provided a power connector 92 for coupling with a 120 volt A.C. power distribution system. Power connector 92 is wired internal of base housing 32, not shown, to provide power for air circulating fans, and one or more duplex receptacles 156 coupled to an interior cover plate 154. Additionally, the electrical transmission system 40 includes a plurality of electronic signal line connectors 94 coupled to external cover plate 150 to provide electrical signal interchange with a respective plurality of connectors 160 coupled to interior cover plate 154. Interior cover plate 154 being disposed on an upper surface of the base housing 32 on the interior of enclosure 11, provides means by which those sounds generated within enclosure 11 can be coupled to electronic equipment, such as amplifiers, magnetic recording equipment, or the like. Additionally, electrical transmission system 40 allows for the coupling of electronic signals generated external to enclosure 11 to be transmitted to the interior thereof, such as those output from a stereo system. Thereby allowing the user to utilize those signals, by means of speakers or headphones, to play or sing along with prerecorded music. Electrical transmission system 40 may also include additional jacks for telephone or intercom communications so as not to totally isolate the interior of enclosure 11 from the outside world.

Figure 5:
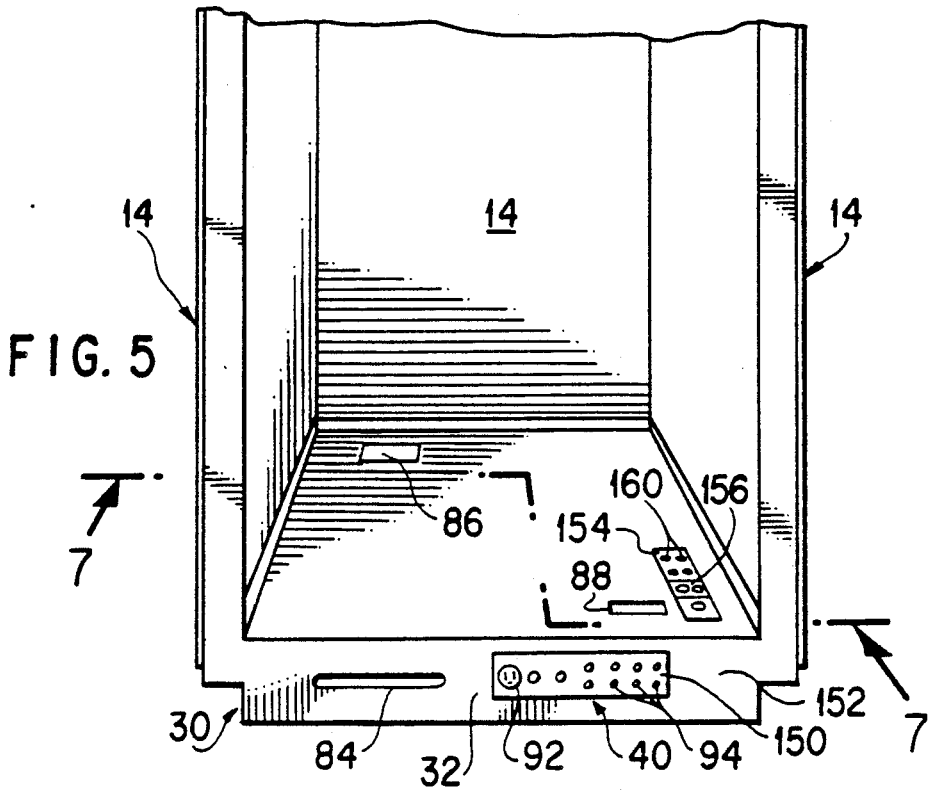
FIG. 5 is a perspective view of the interior of the enclosure formed by the sound attenuating system.
Figure 7:
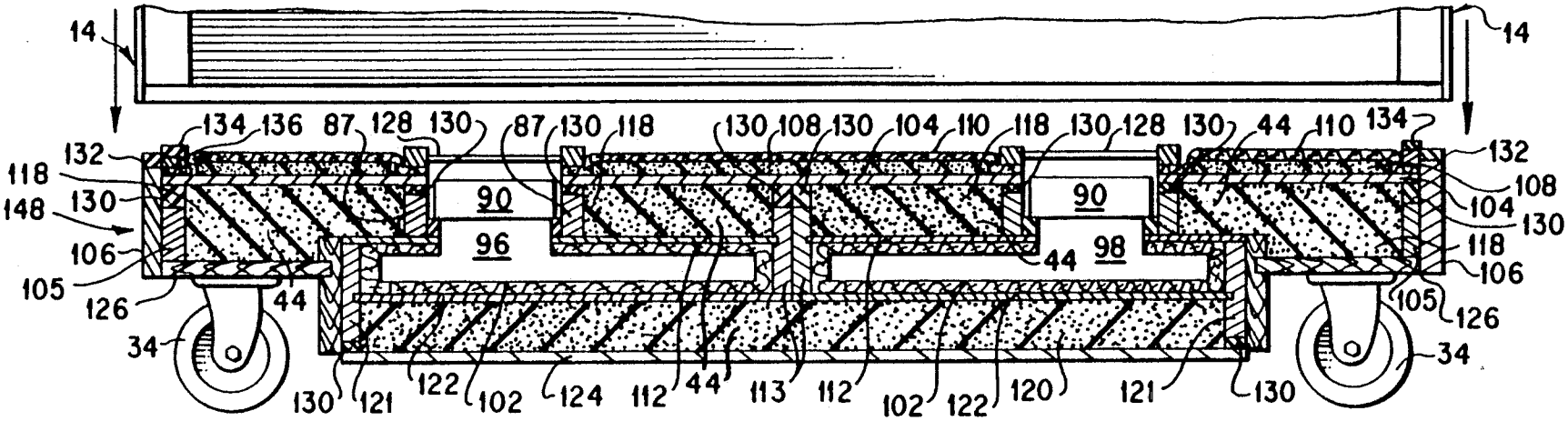
FIG. 7 is a cross-sectional view of the base assembly taken along the section line 7—7 of FIG. 5.

As particularly shown in FIGS. 5 and 7, a pair of ventilation ducts 96 and 98 are provided within the base housing, one acting as a supply for fresh air and the other as an exhaust. The two ducts extend substantially in parallel between two opposing ends of base housing 32 with the exterior inlet/outlet of each duct being disposed on opposing ends of the housing, as are the interior openings 86 and 88. Thus, the duct 96 extends from the external opening 84 formed in end surface 152 of base housing 32 to an interior opening 86 disposed adjacent the opposing end of the base housing. While the interior opening 88 provides fluid communication with the second duct 98, whose exterior outlet 85 is formed in the rear end surface 148 of housing 32, shown in FIG. 2.

The ventilation system for enclosure 11 may include one or more fans, or blowers 90 disposed within a respective one or both of openings 86 and 88 to provide a forced air circulation within the interior of enclosure 11. Alternately, fans 90 may be coupled to the external openings 84, 85 or a remote air conditioning system may be coupled to the external openings of the ducts 96, 98. Further, each of the ducts 96 and 98 are lined with a sound absorbing material 102 for attenuating any sound transmitted therethrough. If additional attenuation is desired for a particular application, baffles may be incorporated into the ventilation ducts.

Each of the ventilation ducts 96 and 98 are defined by a lower duct panel member 122 and an upper duct panel member 112, both extending between opposing end cap members 121 and 113. Below the ventilation ducts 96 and 98 there is provided a cavity 120 defined by the lower duct panel member 122 and a central bottom panel member 124, both extending in spaced parallel relation between the opposing end cap members 121. This lower cavity 120 is filled with sound absorbing material 44, as is similarly done in the wall partitions 14. The central bottom panel member 124 while being coupled to the end cap members 121, and the end surfaces 148 and 152 of base housing 32, is acoustically isolated therefrom by means of an isolation gasket 130 extending about the perimeter of central bottom panel member 124.

Disposed above the ventilation ducts 96 and 98 there is provided an upper sound absorbing cavity 118 defined substantially between the upper duct panel member 112 and the floor panel member 104, the cavity being filled with sound absorbing material 44. In the peripheral side portions of base housing 32, the cavity 118 is defined between the floor panel member 104 and the perimeter bottom panel members 126 to which the casters 34 are coupled. As a means of providing maximum acoustic attenuation, the floor panel 104 is substantially totally isolated from its supporting members 105 and 113, as well as the exit duct members 87, by means of isolation gaskets 130.

Above the floor panel member 104 there is provided a top pad member 108, which may be formed of a foamed plastic or rubber composition, of the type typically used as a carpet padding material. Disposed over the padding 108 there is provided a top covering 110 formed of a short napped carpet material, but other materials may be suitably used. The top covering 110 is secured to the floor panel member 104 by means of a plurality of strip members 136 overlaying the perimeter edge portions of floor panel member 104. The interior ventilation openings 86 and 88 are covered by respective vent diffuser covers 128, for directing the air flow passing therethrough, and further providing means for securing the top covering 110 about the perimeter of the openings 86 and 88.

Coupled to an upper surface of the strip members 136 there is provided an inner perimeter gasket 134 for isolating the floor panel member 104 from the wall partitions 14 which are partially supported thereon. Additionally, there is provided an outer perimeter gasket 132 coupled to the side panel members 106 and the opposing end members of base housing 32 to provide acoustic isolation from the perimeter wall panels 14 which rest thereon. Thus the wall partitions 14 rest on both perimeter gasket 132 and 134.

Figure 11:
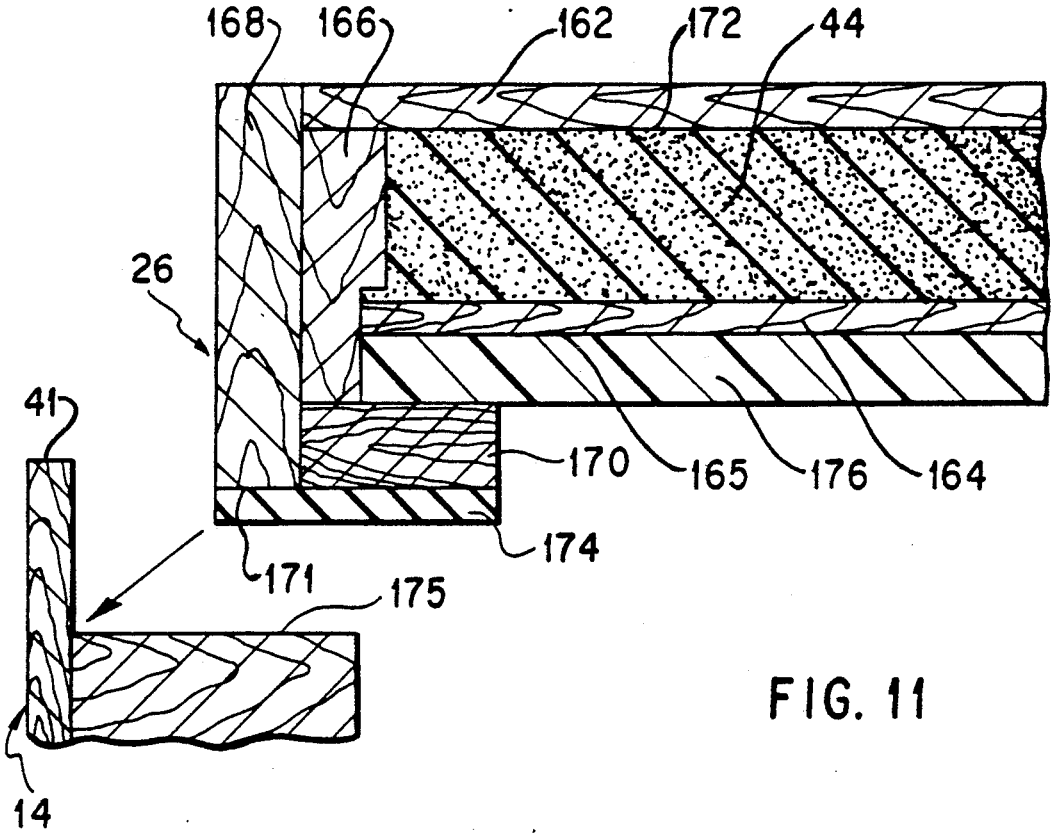
FIG. 11 is a sectional view of the ceiling assembly of the sound attenuating system.

Referring now to FIGS. 2 and 11, there is shown, the ceiling assembly 26 which is supported by the upper end portions of at least two wall partitions 14. Ceiling assembly 26 is symmetrically constructed with a ceiling top panel member 162 extending between opposing side panel members 168 and adjacent support members 166. A ceiling bottom panel member 164 is disposed in spaced parallel relation with ceiling top panel member 162 and extends between opposing support members 166 for defining a cavity 172 between panel members 162 and 164. The cavity 172 is filled with a sound absorbing material 44, wherein the size of cavity 172 has been predetermined for containing sufficient sound absorbing material 44 to provide the level of attenuation required for a particular application.

The interior facing surface 165 of bottom panel member 164 is disposed adjacent an acoustical panel member 176. Both ceiling bottom panel member 164 and acoustical panel member 176 are retained within the ceiling assembly 26 by means of a plurality of bottom cap members 170 extending about the perimeter of the ceiling structure, adjacent the outer side panel members 168. Thus, both the acoustical panel member 176 and ceiling bottom panel member 164 float within the ceiling assembly 26, thereby reducing conduction of acoustic energy through the structure. Acoustic panel member 176 like the panels 140 of wall partitions 14, may be formed from any of a large variety of sound absorbing materials. One commercially available sound absorbing panel which has been successfully utilized has the designation of Classic Minaboard, available from Armstrong World Industries, Inc. of Lancaster, Pa.

The lower perimeter edge 171 of ceiling assembly 26, defined by the lower edge surface of outer side panel members 168 and the outer surface of bottom cap members 170, is coupled to an isolation gasket 174 to provide acoustic isolation between the ceiling assembly 26 and the wall partitions 14 upon which it is supported. The ceiling assembly 26 is nested between opposing wall partitions 14, between the respective upper edges 41 of opposing partitions, and resting on the upper end surfaces 175 of each respective wall partition 14.

Figure 8:
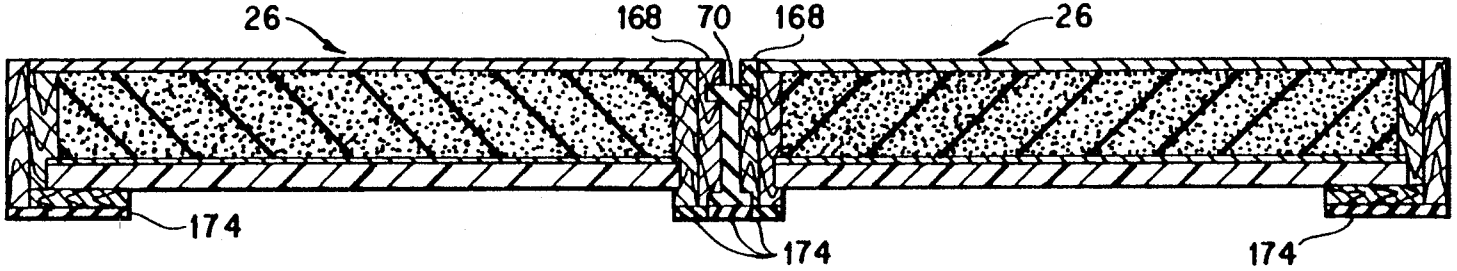
FIG. 8 is a cross-sectional view of a pair of ceiling assemblies joined together.

Referring now to FIG. 8, there is shown the method by which ceiling panels may be joined one to the other, in a manner similar to the method utilized for coupling wall partitions. Adjoining outer side panel members of respective ceiling assemblies 26 are each provided with an extended slotted opening for receipt of projecting portions of the coupling gasket 70. Similarly, each of the adjoining outer side panel members may be provided with at least one recess for receiving the opposing projecting end of the coupling gasket 70, as was previously described for the wall partitions of FIG. 4. Although not shown, each of the ceiling assemblies 26 are secured one to the other by means of the flexible coupling system 18, wherein a plurality of strap-like members are releasably coupled between the adjoining ceiling assemblies 26, as is similarly done in coupling the wall partitions together, Likewise, base assemblies 30 may be coupled together in a like manner utilizing gasket 70 and flexible coupling system 18.

Figure 10:
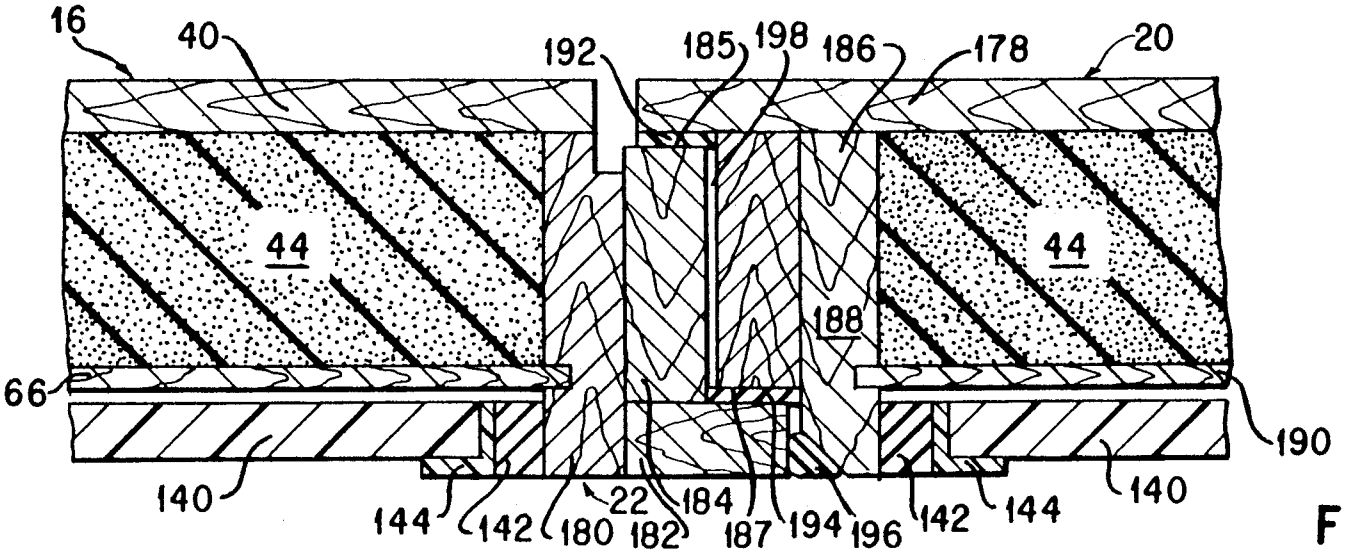
FIG. 10 is a sectional view of the door showing the door seal arrangement.

Referring now to FIG. 1 and the cross-sectional view of FIG. 10, wherein the door/door jamb interface of the wall partition 16 is shown. The opening formed in wall partition 16 is lined by an opening slat member 180, forming part of the door frame, or jamb, assembly 22. Door assembly 22 further includes an inner frame member 182 coupled to an interior end portion of opening slat member 180, and extending interior the opening defined by the slat members 180, toward the door assembly 20. A third member of the door frame assembly 22, outer frame member 184, is coupled to both inner frame member 182 and slat member 180. Outer frame member 184 extends substantially orthogonal to inner frame member 182, extending in a direction toward the exterior of wall partition 16.

Door assembly 20 comprises an outer panel 178 to which is coupled a plurality of door slat members 188, adjacent the perimeter edge thereof. As in the wall partition slat members, door slat members 188 are coupled to the outer door panel 178, and have a slotted opening formed therein for receipt of an inner panel member 190. The two substantially parallel panel members 178 and 190 and opposing slat members 188 defining a cavity in which is filled a sound absorbing material 44. As is similarly done in the construction of the wall partitions, the interior surface of the door assembly 20 is formed by an acoustical panel 140 secured between opposing channel members 144, which are in turn secured to opposing door slat members 188 by means of a double-backed adhesive resilient gasket 142. Coupled to and extending from outer door panel 178 and the external surface of door slat member 188 there is provided an outer door edge member 186 having dimensions substantially equal to those of outer frame member 184, the width dimensions of both members being predetermined so as to form a gap, or air space 198 therebetween when the door abuts the door jamb.

Figure 9:
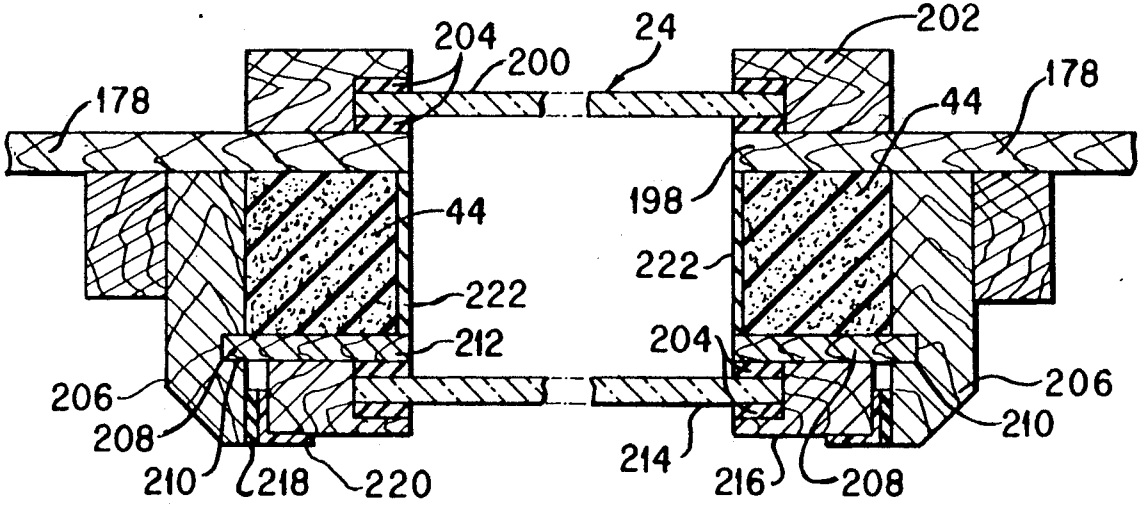
FIG. 9 is a cross-sectional view of the window portion of the door for the sound attenuating system.

As shown in FIG. 9, the outer door panel 178 extends to substantially overlay the outer end 185 of outer frame member 184, the extension of panel 178 having a gasket seal 192 coupled thereto for interface with outer end 185 of outer frame member 184. Gasket seal 192 extends from the outer perimeter edge of outer panel 178 to outer door edge member 186. Inner frame member 182 likewise extends to substantially overlay the end 187 of outer door edge member 186, and has coupled thereto an intermediate door sealing gasket 194 for interface with end 187 of door edge member 186. Thus, the air space 198 is sealed on opposing ends by respective gaskets 192 and 194 to provide a good acoustic seal around the door. The spatial relationships between the outer panel member 178, the outer frame member 184, the outer door edge member 186, the inner frame member 182 and the interior portion of door slat member 188 define a tortuous path through which acoustic energy is substantially attenuated. The interior end of this tortuous path is further sealed by means of an interior gasket member 196 coupled to the end of inner frame member 182 for interface with a beveled edge portion of the door slat member 188.

Referring now to FIG. 9, there is shown a cross-sectional view of the window portion of door assembly 20. For clarity, only the essential elements of the door assembly relating to the window 24 are depicted. An opening 198 is formed in the outer door panel 178 to define a window opening for system 10. External to opening 198 there is provided an outer glass panel 200 secured to cuter door panel 178 by means of a window frame 202 coupled to panel member 178. Outer glass panel 200 is isolated from door panel 178 and window frame 202 by means of gasket seals 204 disposed on opposing sides cf glass panel 200 and extending about the perimeter edge thereof.

On the interior surface of outer door panel 178 there is provided a plurality of window slat members 206, each being disposed a predetermined distance from a respective edge of opening 198. Each of window slat members 206 are provided with a slotted opening 210 formed therein for receipt of an interior window panel member 208. Window panel member 208 is provided with a through opening 212 having a size substantially equal to that of opening 198 formed in outer door panel 178. Overlaying window panel member through opening 212 there is provided an inner glass panel 214 releasably secured to window panel member 208 by means of an inner window frame 216 coupled to door assembly 20 external the opening 212.

Inner glass panel 214 is similarly isolated from the window frame 216 and inner window panel 208 by means of window gasket members 204, extending about the opposing sides of the perimeter edge of glass panel 214. Inner window frame 216 is secured between opposing window slat members 206 by means of right angle retainer members 220 coupled to slat members 206 by means of a double-backed adhesive gasket 218.

A porous cover 222 is extended between the panel members 178 and 208, about the openings 198 and 212, thereby defining a cavity which is filled with sound absorbing material 44. Porous cover material 22 may be formed by any number of commercially available materials, such as various woven cloths, perforated sheet materials, or cellular foam sheet materials.

Figure 6:
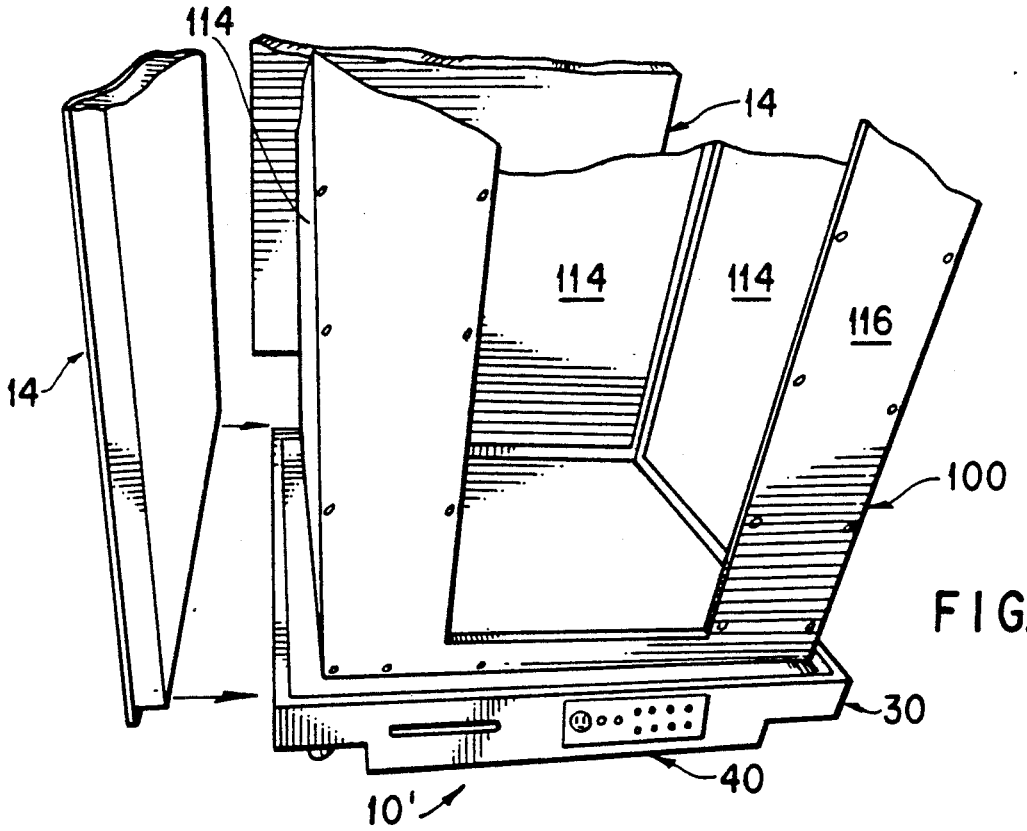
FIG. 6 is a perspective view depicting the interior of an alternate embodiment of the sound attenuating system.

FIG. 6 shows a partially exploded view of an alternate embodiment of the inventive concept. Knockdown sound attenuating system 10' includes all of the features of system 10, and additionally includes an interior sound attenuating booth 100 for further attenuating sound emissions therefrom. System 10' includes a plurality of inner wall panels 114, coupled one to another by a tongue-and-groove arrangement, not shown. Additionally, one of the wall panels 116 is provided with a door opening formed therein. Each of the wall panels 114 and 116 are supported on the base assembly 30, interior of the wall partitions 14.

Figure 13:
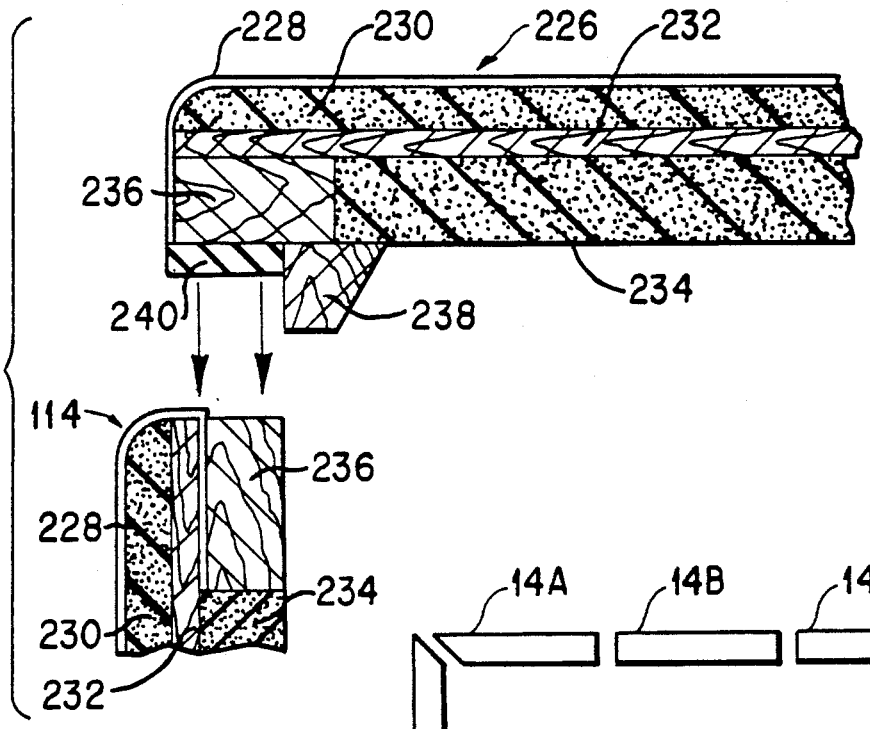
FIG. 13 is a sectional view of the ceiling panel of the inner enclosure of the alternate embodiment of the sound attenuating system shown in FIG. 6.

Referring now to FIG. 13, there is shown the construction of interior wall panels 114 and one embodiment for an upper closure for the interior booth 100. Each interior wall panel 114 and the ceiling panel 226 are similarly constructed, each having a support panel 232 defining the height and width of the respective wall or ceiling panel. Coupled to the exterior surface of support panel 232 there is provided a sound absorbing cellular foam material covered by an outer covering material 228, which may be a woven fabric or upholstery type material. The interior surface of support panel 232 is framed by a plurality of support members 236 extending about the perimeter thereof. Disposed within the framing members 236 there is provided one or more acoustical panel members 234 coupled to support member 232 in a like manner to the coupling system in wall partitions 14. As has been previously described, acoustical panel member 234 may be a commercially available acoustical ceiling tile type structure.

Interior ceiling panel 226 is constructed similar to that of interior wall panel 114, with the exception that the interior facing perimeter edge includes an isolation gasket 240 for interface with the upper end surface of respective interior wall panels 114. Additionally, a guide member 238 is located a predetermined distance from the perimeter edge of ceiling panel 226 so as to locate the ceiling panel with respect to the wall panels. As with the wall panels 114 being located interior to the space defined by the wall partitions 14, ceiling panel 226 is located below the outer ceiling assembly 26 to define a double wall enclosure.

Figure 12:
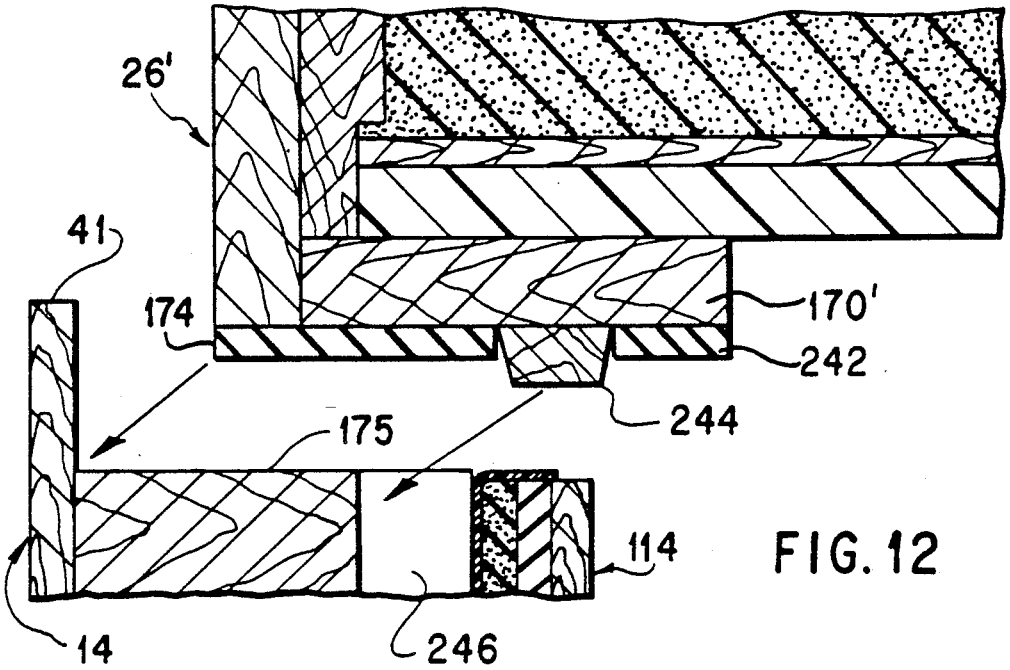
FIG. 12 is a sectional view of the ceiling assembly of an alternate embodiment of the sound attenuating system.

Referring now to FIG. 12, there is shown an alternate embodiment for the upper closure of system 10'. In this embodiment, a modified ceiling assembly 26' provides the closure for both the space interior to wall partitions 14 and interior panels 114. Ceiling assembly 26' is constructed identical to ceiling assembly 26 with the exception that a bottom cap member 170' is provided and extends inwardly so as to overlap both the mating surface 175 of partition 14 and the upper end portion of interior panel 114. Ceiling assembly 16' is isolated from wall partition 14 by the isolation gasket 174 and isolated from the interior wall panel 114 by a second isolation gasket 242. Intermediate gaskets 174 and 242 there is provided a guide member 244 for receipt within the air space 246 disposed between the interior surface of wall partition 14 and the exterior surface of interior panel 114. Guide member 244 aids in maintaining the separation between interior panels 114 and wall partitions 14.

Figure 14:
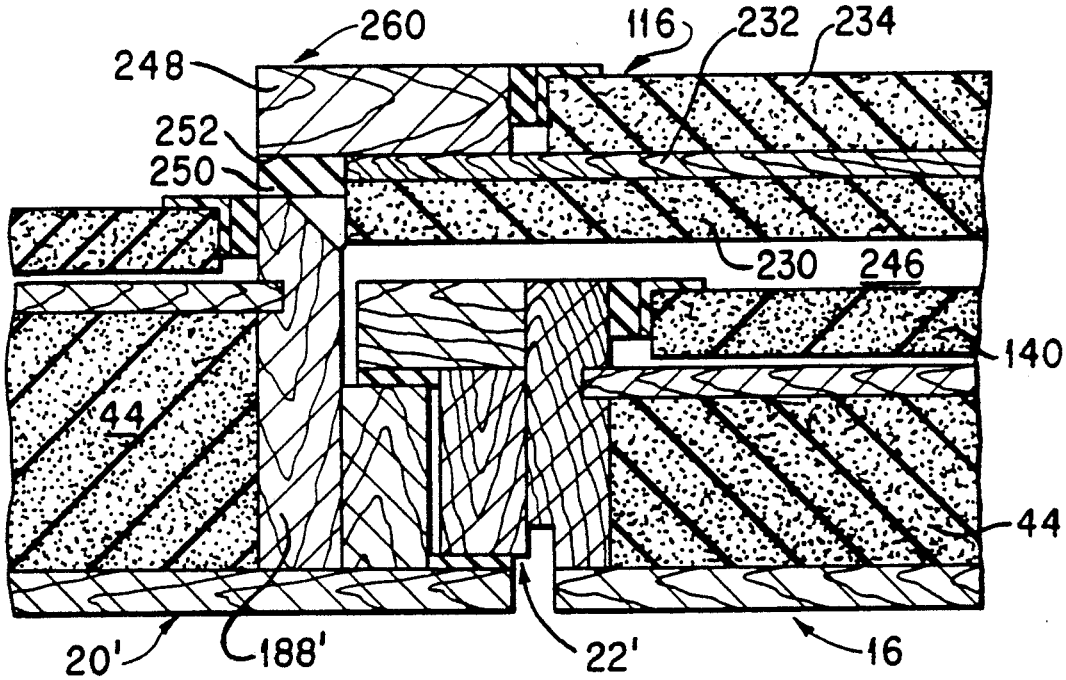
FIG. 14 is a sectional view of the door assembly and seal arrangement for the alternate embodiment shown in FIG. 6; and, FIG. 15 is an exploded diagrammatic view of a modular enclosure constructed with the sound attenuating system.

System 10' includes a door assembly 20' which sealingly interfaces with a door jamb assembly 22' and an interior door jamb assembly 260, as shown in FIG. 14. Door jamb assembly 22' is identical to door jamb assembly 22 with the exception that the inner door seal member is not provided. Likewise, door assembly 20' is substantially identical to door assembly 20 with the exception that the door slat member 188' of door assembly 20' extends further into the interior of enclosure 100 for contacting the interior door jamb assembly 260. As a result of the extended door slat member 188', the insulation filled cavity within the door assembly 20' is of increased volume with respect to the door assembly 20.

Surrounding the door opening formed in the interior panel 116 there is provided the door jamb assembly 260. Door jamb assembly 260 comprises a plurality of interior door jamb members 248 which together frame the interior opening formed in panel 116. Each interior door jamb member 248 extends beyond the panel support member 232 into the door opening for providing a mounting surface for the interior sealing gasket 250.

Interior sealing gasket 250 interfaces with the interior edge portion of the door slat member 188, providing a seal for the air space 246 disposed between the interior surface of the wall partition 16 and the external surface of the wall panel 116. As in the sealing arrangement for the door assembly 20 of system 10, the door assembly 20' of system 10' provides a tortuous path with an air space defined between a pair of sealing gaskets.

As previously described, both embodiments of the knock-down sound attenuating system include a unique structure for simultaneously releasably coupling one wall partition to another and providing an acoustic seal. This coupling system includes a gasket structure having at least one pair of opposing projecting members, each projecting member being insertable into a recess formed in the longitudinal end portion of the wall partition, and having an extended shank portion extending between the two abutting end portions of the partitions, the gasket extending substantially the entire length of wall partitions. The partitions being further secured by means of a flexible coupling system comprising a strap-like member extending between two adjoining panels, fixedly coupled to one and releasably coupled to the other. This arrangement providing for a modular system which is easily assembled and disassembled for convenient shipping, storage, and transportability.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A knock-down sound attenuating system, comprising:

a plurality of sound attenuating wall partitions having a predetermined height dimension, each of said plurality of sound attenuating wall partitions having an external surface portion and being releasably coupled each to another on opposing sides thereof, each of said plurality of sound attenuating wall partitions having a first and a second end portion disposed adjacent said opposing sides of said external surface portion, each of said first and second end portions having at least one recess formed therein, said at least one recess extending longitudinally a distance substantially equal said predetermined height;

gasket means for (1) interlocking said wall partitions, and (2) substantially simultaneously providing a seal against acoustic leakage, said gasket means being disposed between said first end portion of one wall partition and said second end portion of an adjacent wall partition, said gasket means including a longitudinally extended body member and at least an opposing pair of projecting members, said opposing pair of projecting members being insertable into a respective recesses formed in said first and second end portions of adjoining wall partitions;

flexible coupling means coupled to each said plurality of wall partitions for releasably securing each said wall partition to another, said flexible coupling means including at least one flexible strap-like member coupled to each of said plurality of wall partitions, each of said strap-like members having one end fixedly coupled to said external surface portion adjacent said first end portion of a respective one of said wall partitions, said strap-like member having an opposing end releasably coupled to said external surface portion adjacent said second end portion of an adjacent other of said wall partitions; and, ceiling means disposed between and supported by upper end portions of at least two of said plurality of said wall partitions for forming an upper closure for said system, said support of said ceiling means by said upper end portions of said wall partitions being devoid of fasteners, said ceiling means includes (1) at least one sound attenuating ceiling partition having predetermined dimensions for overlaying said upper end portions of said wall partitions, and (2) means for acoustically isolating said ceiling partition from said upper portions of said at least two wall partitions disposed on a contacting surface therebetween.

2. The knock-down sound attenuating system as recited in claim 1 where said releasable coupling means further includes means for detachably releasing each of said strap-like members, said detachable release means being disposed adjacent a second end of each of said wall partitions.

3. The knock-down sound attenuating system as recited in claim 1 where said sound attenuating system further comprises base support means disposed on a base surface for supporting said plurality of wall partitions and acoustically isolating an interior space defined by said wall partitions from said base surface, said base support means including at least on base housing having a perimeter edge portion for supporting said wall partitions, said base support means including means for acoustically isolating each of said plurality of wall partitions from said base housing disposed on said perimeter edge portion of said base housing.

4. The knock-down sound attenuating system as recited in claim 3 where said base support means includes electrical transmission means for coupling electrical power and signal lines from an external surface of said base housing to said interior space.

5. The knock-down sound attenuating system as recited in claim 4 where said base support means includes ventilation means disposed within said base housing for exchanging air within said interior space with air disposed external said sound attenuating system.

6. The knock-down sound attenuating system as recited in claim 5 where said base support means further includes a plurality of wheel members rotatively mounted to a lower surface of said base housing.

7. The knock-down sound attenuating system as recited in claim 6 where said ventilation means includes (1) at least two ducts extending from an external surface of said base housing to said interior space, and (b 2) means for air displacement disposed in at least one of said two ducts.

8. The knock-down sound attenuating system as recited in claim 7 wherein said two ducts are disposed within a cavity formed in said base housing, said cavity having a sound absorbing fill material disposed therein substantially surrounding said two ducts.

9. The knock-down sound attenuating system as recited in claim 1 where at least one of said wall partitions includes closure means coupled to a portion of said wall partition substantially surrounding a through opening formed in said wall partition for reversibly sealing an interior space defined by said plurality of wall partitions.

10. The knock-down sound attenuating system as recited in claim 9 where said closure means includes a door frame assembly coupled to said portion of said wall partition substantially surrounding said through opening, said door frame assembly including a plurality of door jamb members, each of said door jamb members having at least a first sealing surface disposed adjacent said interior space and a second sealing surface disposed adjacent an external surface of said door jamb member.

11. The knock-down sound attenuating system as recited in claim 10 where said closure means includes a door assembly hingedly coupled to said door frame assembly.

12. The knock-down sound attenuating system as recited in claim 11 where said closure means further includes seal means disposed at an interface between said door jamb members and said door assembly for substantially attenuating acoustic leakage therefrom, said interface defining a tortuous path between said interior space and an external surface of said door.

13. The knock-down sound attenuating system as recited in claim 12 where said seal means includes at least a pair of gasket members disposed between said door jamb members and said door assembly, each of said gasket members being positionally located at a respective one of said first and second sealing surfaces.

14. The knock-down sound attenuating system as recited in claim 13 where said seal means further includes a longitudinally extended air space disposed between said gasket members.

15. The knock-down sound attenuating system as recited in claim 1 where said sound attenuating system further comprises a plurality of interior wall partitions disposed within a first interior space defined by said sound attenuating wall partitions, said interior wall partitions and said sound attenuating wall partitions being supported by a common base, said interior wall partitions being supported in spaced substantially parallel relationship with respect to said sound attenuating wall partitions and acoustically isolated therefrom.

16. The knock-down sound attenuating system as recited in claim 15 where said sound attenuating system includes interior ceiling means disposed over said interior wall partitions for forming an upper closure for a second interior space defined by said interior wall partitions.

17. The knock-down sound attenuating system as recited in claim 16 where said ceiling means is supported by said sound attenuating wall partitions, thereby simultaneously forming an upper closure for both said first and second interior spaces.

18. The knock-down sound attenuating system as recited in claim 1 where said longitudinally extended body member and said opposing pair of projecting members are formed with a rigid core and a resilient outer layer.

19. A transportable knock-down sound attenuating system, comprising:

a plurality of sound attenuating wall modules releasably coupled one to another for defining a cavity space therein, at least one of said plurality of wall modules having a through opening formed therein;

closure means coupled to said at least one wall module in overlapping relationship with said through opening for permitting access to said cavity space, said closure means including:

a. a door frame assembly coupled to said wall module having said through opening formed therein, said door frame assembly including a plurality of door jamb members, each of said door jamb members having at least a first sealing surface disposed adjacent said cavity space and a second sealing surface disposed adjacent an external surface of said door jamb member;

b. a door assembly hingedly coupled to said door frame assembly; and, c. seal means disposed at an interface between said door jamb members and said door assembly for substantially attenuating acoustic leakage therefrom, said seal means including at least a pair of gasket members disposed between said door jamb members and said door assembly, each of said gasket members being positionally located at a respective one of said first and second sealing surfaces, said seal means further including a longitudinally extended air space disposed between said gasket member to define a tortuous path between said cavity space and an external surface of said door for substantially attenuating acoustic energy;

sound isolating base means for supporting said plurality of wall modules about a perimeter edge thereof, said sound isolating base means including a floor panel member for forming a bottom closure for said cavity space, said floor panel member being acoustically isolated from said perimeter edge portion of said base means to thereby acoustically isolate said floor panel member from said sound attenuating wall modules;

ceiling means for forming a sound attenuating upper closure for said cavity space, said ceiling means being supported by at least an opposing pair of said plurality of wall modules, said ceiling means including acoustic isolation means disposed on a contacting surface between said ceiling means and said wall modules; and coupling means disposed on an external surface portion of each of said plurality of wall modules for releasably coupling without tools each of said wall modules to an adjacent other wall module, said coupling means including at least one flexible strap-like member coupled to each of said plurality of wall modules, each of said strap-like members having one end fixedly coupled to said external surface portion of a respective one of said wall modules, said strap-like member having an opposing end releasably coupled to said external surface portion of an adjoining other of said wall modules.

* * * * *